US007652629B2

(12) United States Patent
Teshima

(10) Patent No.: US 7,652,629 B2
(45) Date of Patent: Jan. 26, 2010

(54) ANTENNA DEVICE AND RADIO APPARATUS HAVING A BROADBAND CHARACTERISTIC

(75) Inventor: Masao Teshima, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 12/072,345

(22) Filed: Feb. 26, 2008

(65) Prior Publication Data

US 2009/0213016 A1 Aug. 27, 2009

(51) Int. Cl.
*H01Q 1/24* (2006.01)

(52) U.S. Cl. ..... 343/702; 343/700 MS

(58) Field of Classification Search ..... 343/702, 343/700 MS, 725, 846
See application file for complete search history.

(56) References Cited

U.S. PATENT DOCUMENTS 7,068,228 B2 6/2006 Soutome
7,187,331 B2 * 3/2007 Chen et al. ..... 343/702

FOREIGN PATENT DOCUMENTS

| | | | |
|---|---|---|---|
| JP | 2002-64324 | A | 2/2002 |
| JP | 2005-94501 | A | 4/2005 |
| WO | WO 2005/004282 | A1 | 1/2005 |

* cited by examiner

*Primary Examiner*—Hoang V Nguyen
(74) *Attorney, Agent, or Firm*—Frishauf, Holtz, Goodman & Chick, P.C.

(57) ABSTRACT

An antenna device including a ground plane, a plane conductor and a line conductor is provided. The plane conductor is shaped like a polygon having a first side, a second side and an angle between the first side and the second side. The plane conductor is arranged almost on a same plane as the ground plane. The plane conductor has a feed portion around the angle. The first side faces a side of the ground plane. The line conductor is arranged almost on the same plane as the ground plane. The line conductor has a first end and a second end. The first end is connected to an end of the second side being opposite the feed portion.

13 Claims, 7 Drawing Sheets

ANTENNA DEVICE AND RADIO APPARATUS HAVING A BROADBAND CHARACTERISTIC

BACKGROUND OF THE INVENTION

1. Field of the Invention

The present invention relates to an antenna device and a radio apparatus having a broadband characteristic, and in particular to an antenna device having multiple resonances and a radio apparatus including the antenna device.

2. Description of the Related Art

Known is a broadband antenna device as disclosed in Japanese Patent Publication of Unexamined Applications (Kokai), No. 2002-64324, particularly in FIG. 10. The antenna device of JP 2002-64324 has a ground plane 6 and a planar microstrip antenna 42 arranged parallel to the ground plane 6 , and is configured in such a way that an end of the microstrip antenna 42 is connected to an end of a monopole antenna 1.

The antenna device of JP 2002-64324 has a single resonance. The monopole antenna 1 is about a half as long as a wavelength of a resonant frequency. The planar microstrip antenna 42 is also about a half as long as the wavelength. The planar microstrip antenna 42 may increase its width and thus its electric volume so as to obtain a broad bandwidth.

Known is a planar multi-layered antenna of multiple resonances as disclosed in Japanese Patent Publication of Unexamined Applications (Kokai), No. 2005-94501, particularly in FIG. 5. The planar multi-layered antenna of JP 2005-94501 has a rectangular conductor pattern 43 and a U-shaped line conductor pattern 45. The rectangular conductor pattern 43 is arranged on a same plane as a ground board conductor 49.

The planar multi-layered antenna of JP 2005-94501 has multiple resonances, a first resonant frequency f1 of a current resonance on the U-shaped line conductor pattern 45 as a whole, and a second resonant frequency f2 of a resonance along an inner side of the U-shaped portion of the line conductor, where $f1<f2$.

Although having obtained a broadband characteristic, the above antenna device of JP 2002-64324 does not have a multi-resonance characteristic. Although the planar multi-layered antenna of JP 2005-94501 has resonant frequencies determined by the lengths of the whole U-shaped line conductor pattern 45 and of the inner side of the U-shaped portion of the line conductor, how to broaden the frequency bands is not very specifically disclosed.

SUMMARY OF THE INVENTION

Accordingly, an object of the present invention is to provide an antenna device having a broadband characteristic and multiple resonances, and to provide a radio apparatus including the antenna device.

To achieve the above object, according to one aspect of the present invention, an antenna device including a ground plane, a plane conductor and a line conductor is provided. The plane conductor is shaped like a polygon having a first side, a second side and an angle between the first side and the second side. The plane conductor is arranged almost on a same plane as the ground plane. The plane conductor has a feed portion around the angle. The first side faces a side of the ground plane. The line conductor is arranged almost on the same plane as the ground plane. The line conductor has a first end and a second end. The first end is connected to an end of the second side being opposite the feed portion.

DETAILED DESCRIPTION OF THE INVENTION

Figure 1A:
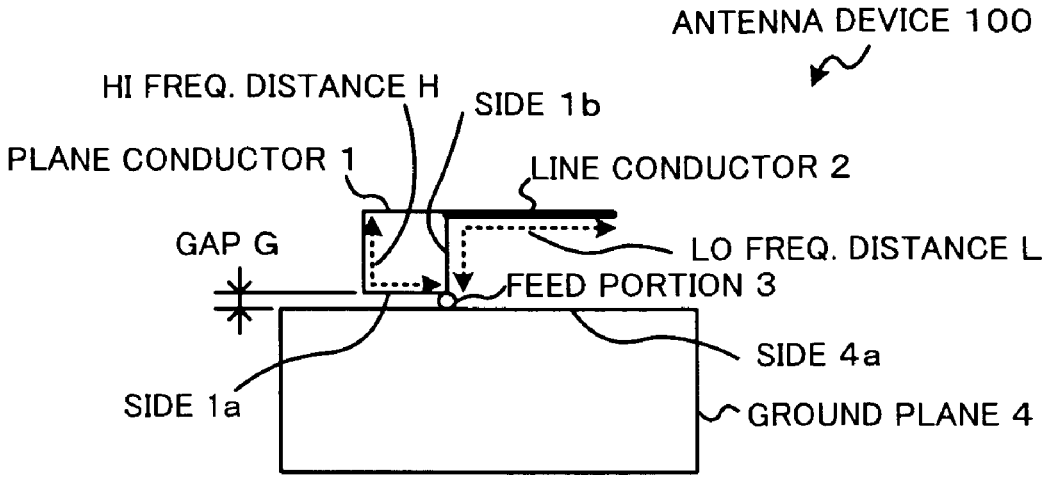
FIG. 1A is an explanatory diagram showing a configuration of an antenna device of a first embodiment of the present invention.

Hereinafter, embodiments of the present invention will be described in detail. In following descriptions, terms like upper, lower, left, right, horizontal or vertical used while referring to a drawing shall be interpreted on a page of the drawing unless otherwise noted. Besides, a same reference numeral given in no less than two drawings shall represent a same member or a same portion.

A first embodiment of the present invention will be described with reference to FIGS. 1A-4. FIG. 1A is an explanatory diagram showing a configuration of an antenna device 100 of the first embodiment. The antenna device 100 has a plane conductor 1, a line conductor 2, a feed portion 3, a ground plane 4 and so forth.

As shown in FIG. 1A, the plane conductor 1 is shaped as a planar quadrilateral. The feed portion 3 is provided around an angle of the quadrilateral of the plane conductor 1. The angle is between two sides of the quadrilateral, i.e., a side 1*a* and a side 1*b*. The side 1*a* faces a side 4*a* of the ground plane 4 across a small gap G. Although being arranged almost parallel to the side 4*a* of the ground plane 4 in FIG. 1A, the side 1*a* may be at a small angle to the side 4*a*. Although being arranged almost perpendicular to the side 4*a* of the ground plane 4 in FIG. 1A, the side 1*b* may be at an angle other than 90 degrees to the side 4*a*.

The line conductor 2 is connected to a portion of the plane conductor 1 around an end of the side 1*b* being opposite the feed portion 3. The portion of the plane conductor 1 to which the line conductor 2 is connected to the plane conductor 1 need not entirely coincide with the end of the side 1*b* being opposite the feed portion 3, but may be around the above opposite end of the side 1*b*, e.g., slightly closer to the feed portion 3. The line conductor 2 may be stick slightly out of the opposite end of the side 1*b* in a vertical direction going away from the feed portion 3, and then extend in a horizontal direction.

The line conductor 2 is a line shaped radiation element, and is arranged almost parallel to the side 4*a* of the ground plane 4. The line conductor 2 may be rod shaped or plane shaped with a narrow width. The plane conductor 1 and the ground plane 4 are arranged almost on a same plane, and so is the line conductor 2.

As shown in FIG. 1A, a low frequency distance L is defined as indicated by a dotted line with arrows between the feed portion 3 and the open end of the line conductor 2, by way of the side 1*b* of the plane conductor 1. The low frequency distance L relates to a relatively low one of multiple resonant frequencies of the antenna device 100 (called the low resonant frequency).

As shown in FIG. 1A, a high frequency distance H is defined as indicated by a dotted line with arrows between the feed portion 3 and an opposite angle of the feed portion 3, by way of the side 1*a* of the plane conductor 1. The high frequency distance H relates to a relatively high one of multiple resonant frequencies of the antenna device 100 (called the high resonant frequency).

Figure 1B:
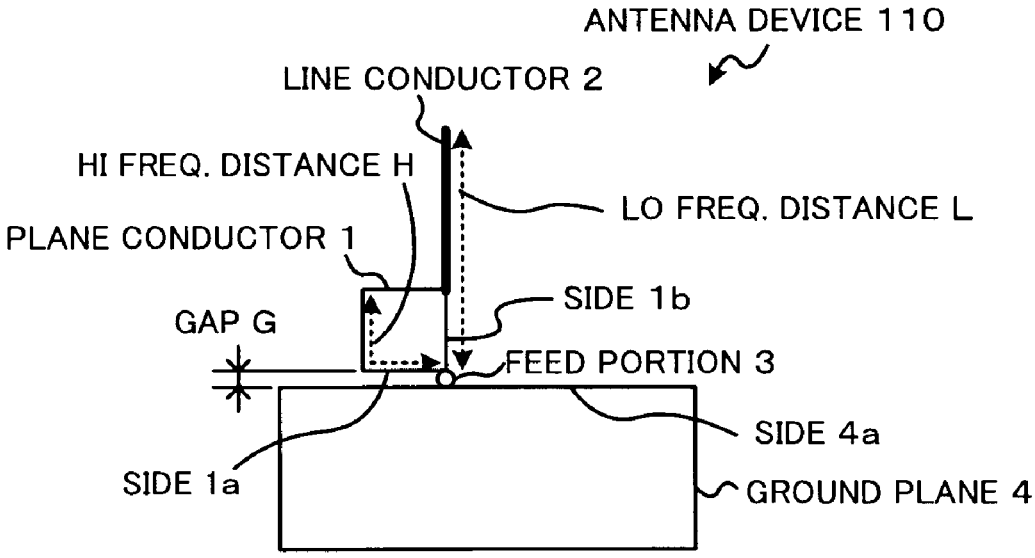
FIG. 1B is an explanatory diagram showing a configuration of a modification of the antenna device of the first embodiment shown in FIG. 1A.

FIG. 1B is an explanatory diagram showing a configuration of an antenna device 110 which is a modification of the antenna device 100 of the first embodiment. The antenna device 110 shown in FIG. 1B is different from the antenna device 100 shown in FIG. 1A in that the line conductor 2 is arranged almost perpendicular to the side 4*a* of the ground plane 4.

As shown in FIG. 1B, a low frequency distance L is defined as indicated by a dotted line with arrows between the feed portion 3 and the open end of the line conductor 2, by way of the side 1*b* of the plane conductor 1, as in FIG. 1A. A high frequency distance H is defined as indicated by a dotted line with arrows between the feed portion 3 and the opposite angle of the feed portion 3, by way of the side 1*a* of the plane conductor 1, as in FIG. 1A.

A relation between the low frequency distance L and the low resonant frequency and a relation between the high frequency distance H and the high resonant frequency will be explained hereafter.

Figure 2A:
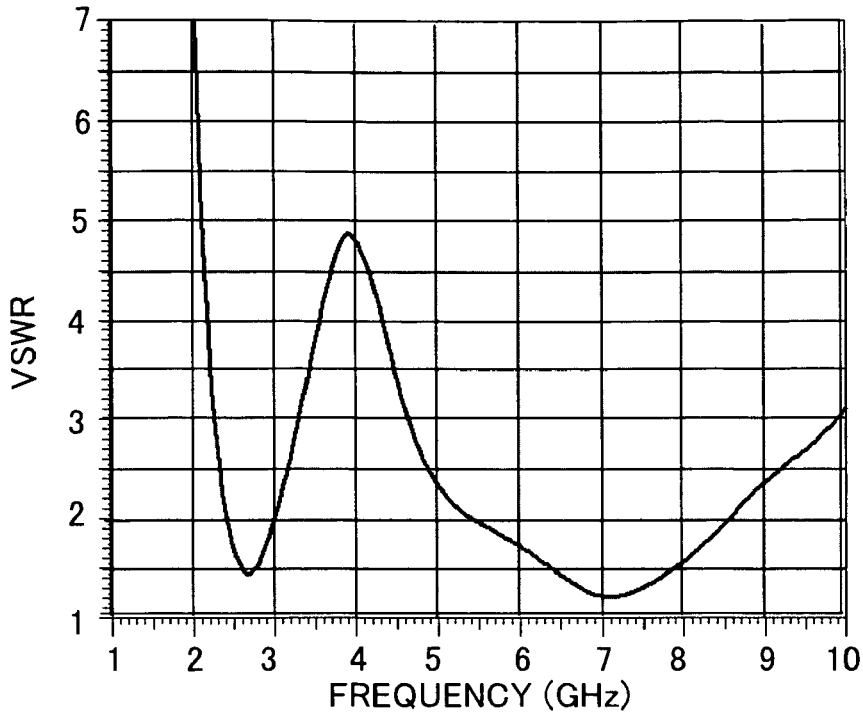
FIG. 2A is a graph of a frequency characteristic of a voltage standing wave ratio (VSWR) of the antenna device of the first embodiment estimated by simulation.

FIG. 2A is a graph of a frequency characteristic of a voltage standing wave ratio (VSWR) of the antenna device 100 or 110 shown in FIG. 1A or 1B estimated by simulation under conditions that the high frequency distance H is 19 millimeters (mm), the low frequency distance L is 30 mm, and the gap G is 0.5 mm.

FIG. 2A has a horizontal axis representing the frequency in gigahertz (GHz) and a vertical axis representing the VSWR. In FIG. 2A, shown are relatively low and high frequency bands in which fairly good VSWR values (no greater than three) may be obtained. Both of the frequency bands show broadband characteristics.

Figure 2B:
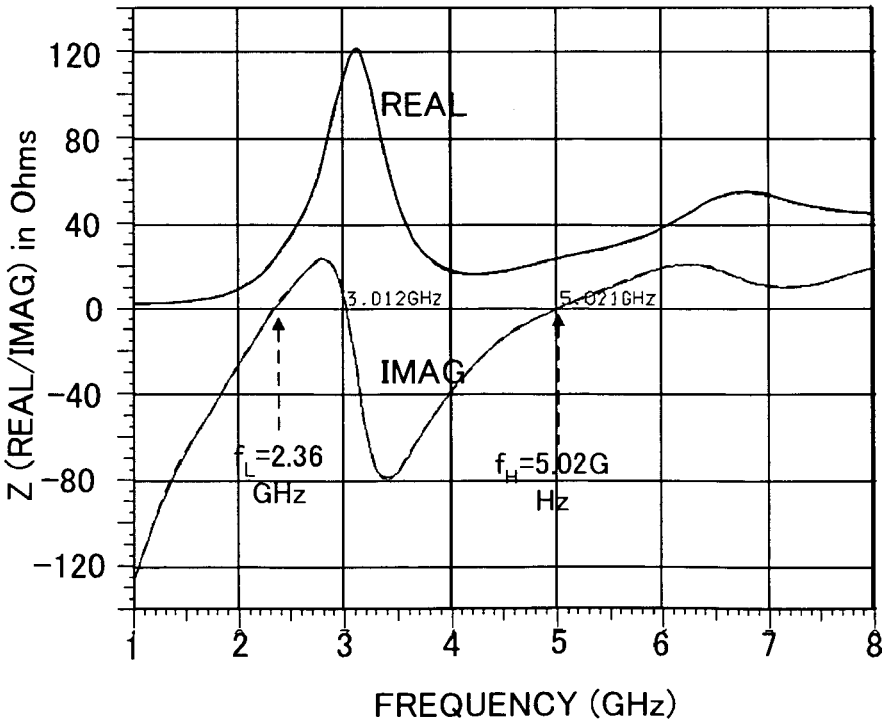
FIG. 2B is a graph of a frequency characteristic of input impedance of the antenna device of the first embodiment estimated by the simulation.

FIG. 2B is a graph of a frequency characteristic of input impedance of the antenna device 100 or 110 estimated by the simulation. FIG. 2B has a horizontal axis representing the frequency in GHz and a vertical axis representing the impedance in ohms. In FIG. 2B, shown are two curves, an upper curve representing a real part (resistance component) of the impedance and a lower curve representing an imaginary part (reactance component) of the impedance.

In FIG. 2B, the curve of the imaginary part crosses a horizontal line of Z=0 at two frequencies which are resonant frequencies. One of the two resonant frequencies is the low resonant frequency denoted by $f_L$ being 2.36 GHz, and a wavelength of $f_L$ is denoted by $\lambda_L$ being 127.1 mm.

Another one of the two resonant frequencies is the high resonant frequency denoted by $f_H$ being 5.02 GHz, and a wavelength of $f_H$ is denoted by $\lambda_H$ being 59.8 mm. The high frequency distance H being 19 mm is 0.32 times (i.e., nearly 0.3 times) as long as the wavelength $\lambda_H$.

Figure 3A:
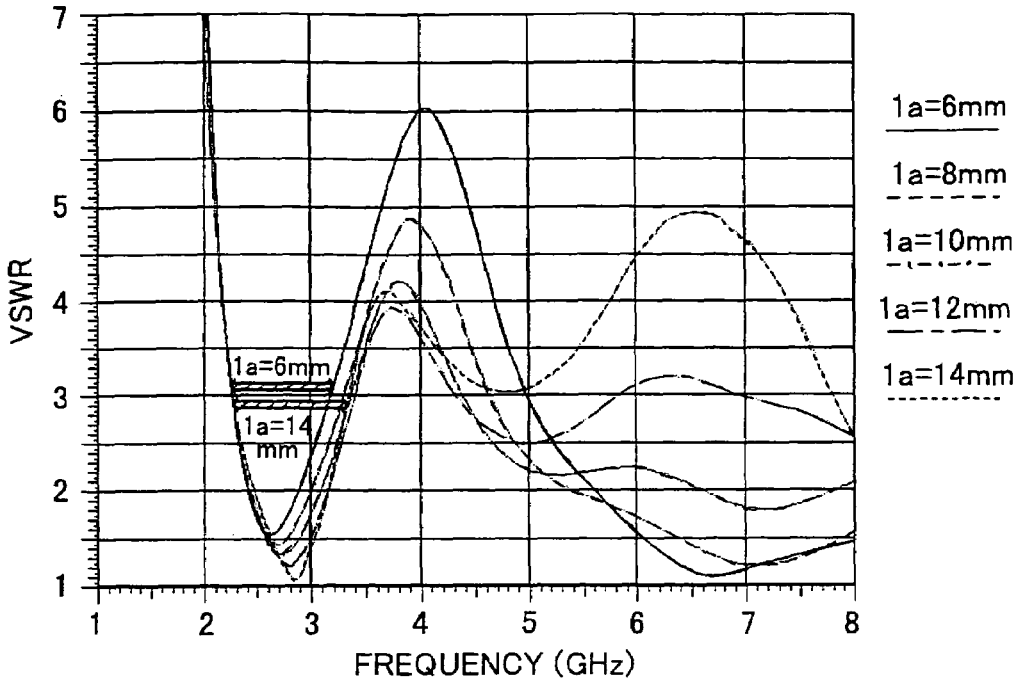
FIG. 3A is a graph of frequency characteristics of the VSWR of the antenna device of the first embodiment estimated by simulation in a case where a width of a plane conductor of the antenna device is selected as a variable parameter.

FIG. 3A is a graph of frequency characteristics of the VSWR of the antenna device 100 or 110 shown in FIG. 1A or 1B estimated by simulation under conditions that the side 1*a*, or a width of the plane conductor 1 shown in FIG. 1A or 1B, is 6-14 mm long, 2 mm apart. As a height of the plane conductor 1 is 11 mm, the high frequency distance H varies between 17 (=11+6) and 25 (=11+14) mm, 2 mm apart. The low frequency distance L and the gap G are given fixed values of 30 mm and 0.5 mm, respectively.

FIG. 3A has a horizontal axis representing the frequency in GHz and a vertical axis representing the VSWR. A bandwidth of the relatively low frequency band for the VSWR being no greater than three is broader if the side 1*a* is 14 mm long than if the side 1*a* is 6 mm long.

Figure 3B:
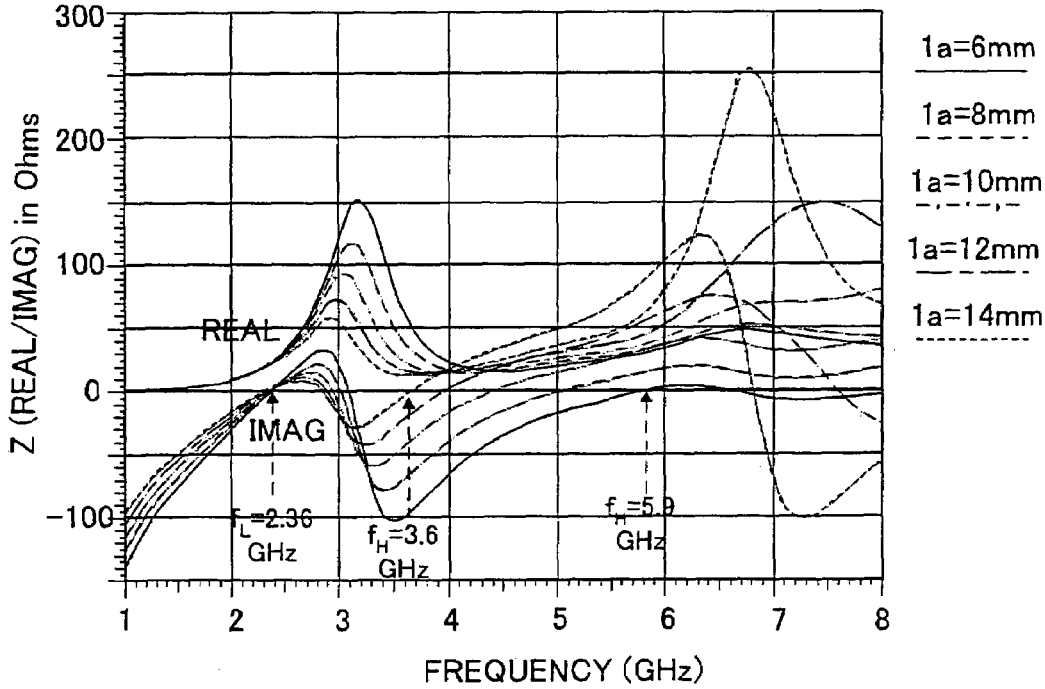
FIG. 3B is a graph of a frequency characteristic of input impedance of the antenna device of the first embodiment estimated by the simulation in a case where the width of the plane conductor of the antenna device is selected as the variable parameter.

FIG. 3B is a graph of frequency characteristics of the input impedance of the antenna device 100 or 110 estimated by the simulation under conditions that the side 1*a* is 6-14 mm long, 2 mm apart. Even if the length of the side 1*a* or the high frequency distance H changes, the low resonant frequency $f_L$ remains 2.36 GHz, and the wavelength $\lambda_L$ remains 127.1 mm. The low frequency distance L being 30 mm is 0.24 times (i.e., nearly a quarter times) as long as the wavelength $\lambda_L$. That is, the low resonant frequency $f_L$ may be determined dependent on the low frequency distance L and independent of other dimensions of the antenna device 100 or 110.

The high resonant frequency is nearly 3.6 GHz and the wavelength $\lambda_H$ is 83 mm, if the side 1*a* is 14 mm long (the high frequency distance H is 25 mm). The high frequency distance H being 25 mm is 0.30 times as long as the wavelength $\lambda_H$.

The high resonant frequency is nearly 5.8 GHz and the wavelength $\lambda_H$ is 51.7 mm, if the side 1*a* is 6 mm long (the high frequency distance H is 17 mm). The high frequency distance H being 17 mm is 0.33 times (i.e., nearly 0.3 times) as long as the wavelength $\lambda_H$.

Figure 4:
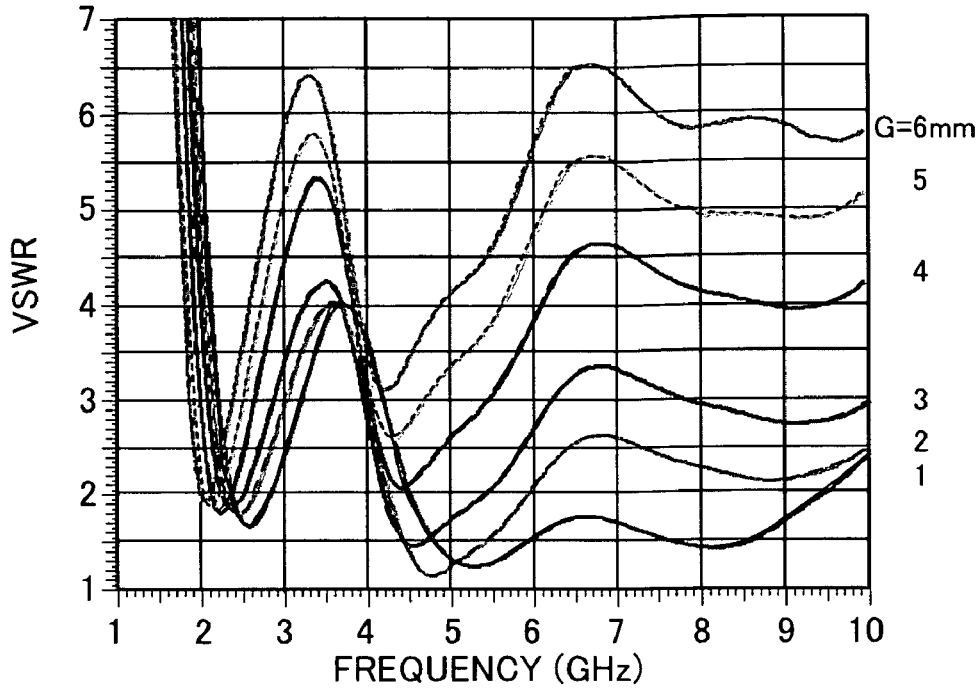
FIG. 4 is a graph of frequency characteristics of the VSWR of the antenna device of the first embodiment estimated by simulation in a case where a width of a gap between the plane conductor and the ground conductor is selected as a variable parameter.

FIG. 4 is a graph of frequency characteristics of the VSWR of the antenna device 100 or 110 shown in FIG. 1A or 1B estimated by simulation under conditions that the gap G shown in FIG. 1A or 1B is 1-6 mm, 1 mm apart. The high frequency distance H and the low frequency distance L are given fixed values of 19 mm and 30 mm, respectively.

FIG. 4 has a horizontal axis representing the frequency in GHz and a vertical axis representing the VSWR. As shown in FIG. 4, the antenna device 100 or 110 has two resonant frequencies in the relatively low frequency band and in the relatively high frequency band. If the gap G is no greater than 5 mm, fairly good VSWR values (no greater than three) may be obtained at both of the resonant frequencies. If the gap G is 6 mm, the VSWR values greater than three at the high resonant frequency.

Although more or less depending upon the value of the gap G, the low resonant frequency $f_L$ is nearly 2.1-2.6 GHz as shown in FIG. 4, and the wavelength $\lambda_L$ is 115-142 mm. The low frequency distance L being 30 mm is 0.21-0.26 times (i.e., nearly a quarter times) as long as the wavelength $\lambda_L$.

Although more or less depending upon the value of the gap G, the high resonant frequency $f_H$ is nearly 4.3-5.3 GHz as shown in FIG. 4, and the wavelength $\lambda_H$ is 57-70 mm. The high frequency distance H being 19 mm is 0.27-0.34 times (i.e., nearly 0.3 times) as long as the wavelength $\lambda_H$.

As expected from FIG. 4, fairly good VSWR values (no greater than three) may be obtained if the gap G is no greater than nearly 0.3 times as long as the high frequency distance H=19 mm, i.e., 5.4 mm.

According to the first embodiment of the present invention described above, the antenna device 100 or 110 may be configured to have multiple resonant frequencies and broadband characteristics, where each of the resonant frequencies is clearly associated with a dimension of each portion of the antenna device.

Figure 5:
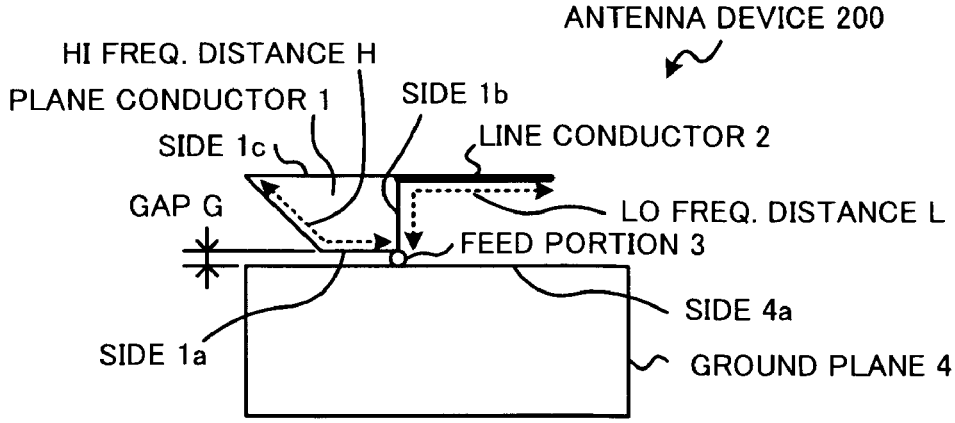
FIG. 5 is an explanatory diagram showing a configuration of an antenna device of a second embodiment of the present invention.

A second embodiment of the present invention will be described with reference to FIGS. 5-6B. FIG. 5 is an explanatory diagram showing a configuration of an antenna device 200 of the second embodiment.

As the configuration of the antenna device 200 is similar to the configuration of the antenna device 100 of the first embodiment except for a few differences, main portions of the antenna device 200 are given same reference numerals as the main portions of the antenna device 100 for convenience of explanation. The differences will be explained hereafter.

The antenna device 200 has a plane conductor 1 having a sloping left side, a lower side 1*a* and an upper side 1*c* being wider than the side 1*a*.

As shown in FIG. 5, a high frequency distance H is defined as indicated by a dotted line with arrows between the feed portion 3 and an opposite angle of the feed portion 3, by way of the side 1*a* of the plane conductor 1. The high frequency distance H relates to a relatively high one of multiple resonant frequencies of the antenna device 200 (called the high resonant frequency).

Figure 6A:
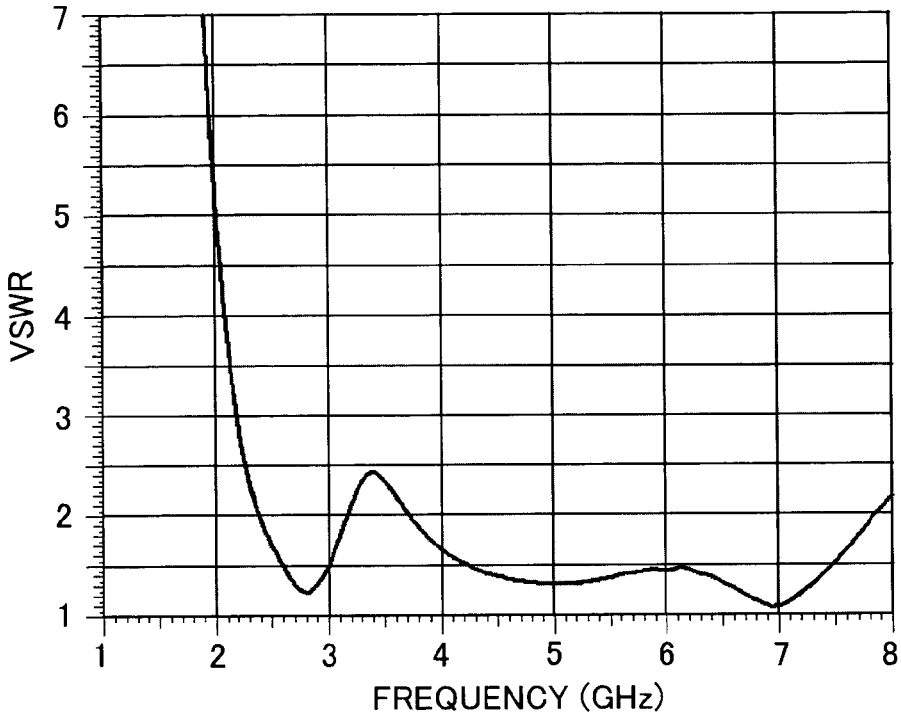
FIG. 6A is a graph of a frequency characteristic of a VSWR of the antenna device of the second embodiment estimated by simulation.

FIG. 6A is a graph of a frequency characteristic of a VSWR of the antenna device 200 shown in FIG. 5 estimated by simulation under conditions that the high frequency distance H values 25 mm, the side 1*a* is 10 mm long, and the gap G is 0.5 mm.

FIG. 6A has a horizontal axis representing the frequency in GHz and a vertical axis representing the VSWR. As shown in FIG. 6A, relatively low and high frequency bands are linked to each other to form a band in which fairly good VSWR values (no greater than three) may be obtained, and which is broader than each of the low and high frequency bands.

Figure 6B:
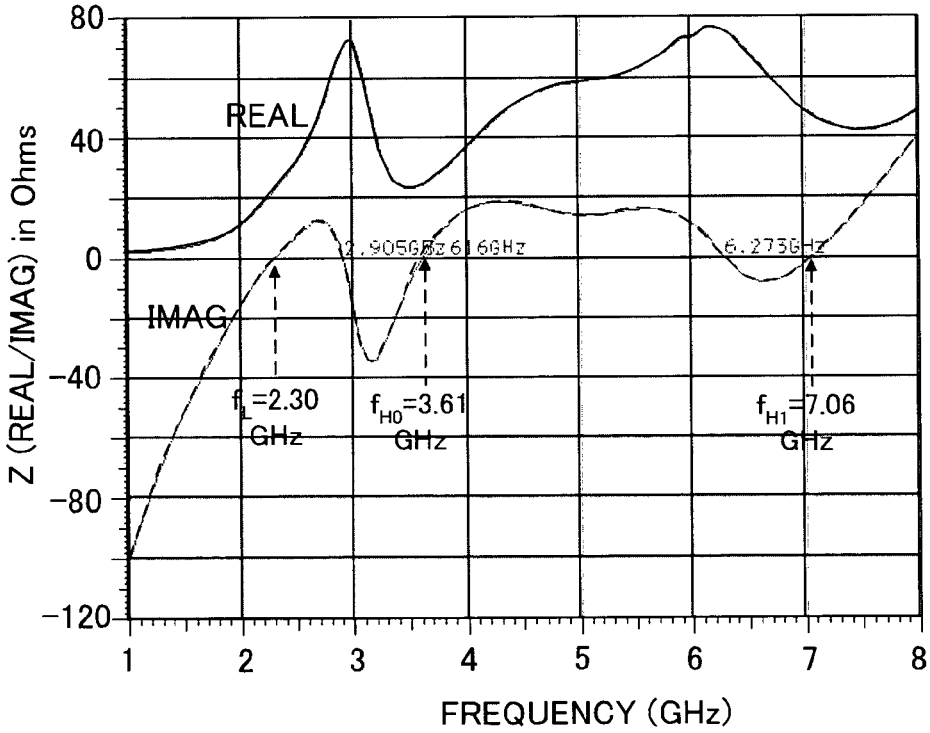
FIG. 6B is a graph of a frequency characteristic of input impedance of the antenna device of the second embodiment estimated by the simulation.

FIG. 6B is a graph of a frequency characteristic of input impedance of the antenna device 200 estimated by the simulation. FIG. 6B has a horizontal axis representing the frequency in GHz and a vertical axis representing the impedance in ohms. In FIG. 6B, shown are two curves, an upper curve representing a real part (resistance component) of the impedance and a lower curve representing an imaginary part (reactance component) of the impedance.

As shown in FIG. 6B, the antenna device 200 has three resonant frequencies at each of which the curve of the imaginary part crosses a horizontal line of Z=0. Each of the resonant frequencies is called a low, high or higher resonant frequency and is denoted by $f_L$, $f_{H0}$ or $f_{H1}$, respectively.

As shown in FIG. 6B, the low resonant frequency $f_L$ is 2.30 GHz and a wavelength of $f_L$ denoted by $\lambda_L$ is 130.4 mm. The low frequency distance L is 0.23 times (i.e., nearly a quarter times) as long as the wavelength $\lambda_L$.

The high resonant frequency $f_{H0}$ is 3.61 GHz and a wavelength of $f_{H0}$ denoted by $\lambda_{H0}$ is 83.1 mm. The high frequency distance H being 25 mm is 0.30 times as long as the wavelength $\lambda_{H0}$.

The higher resonant frequency $f_{H1}$ is 7.06 GHz and a wavelength of $f_{H1}$ denoted by $\lambda_{H1}$ is 42.5 mm. The higher resonant frequency $f_{H1}$ relates to the length of the side 1*a* being 10 mm as mentioned above. The side 1*a* being 10 mm long is 0.24 times (i.e., nearly a quarter times) as long as the wavelength $\lambda_{H1}$.

As described above, matching between resonance of the line conductor 2 at the relatively low frequency and resonance of the plane conductor 1 at the relatively high frequency may be coordinated by adjustment of the width of the upper portion of the plane conductor 1, so that the antenna device 200 may obtain a broader band characteristic.

According to the second embodiment of the present invention described above, the antenna device 200 may be configured to have the broader band characteristic by the linkage between the multiple resonant frequencies, where each of the resonant frequencies is clearly associated with a dimension of each portion of the antenna.

Figure 7A:
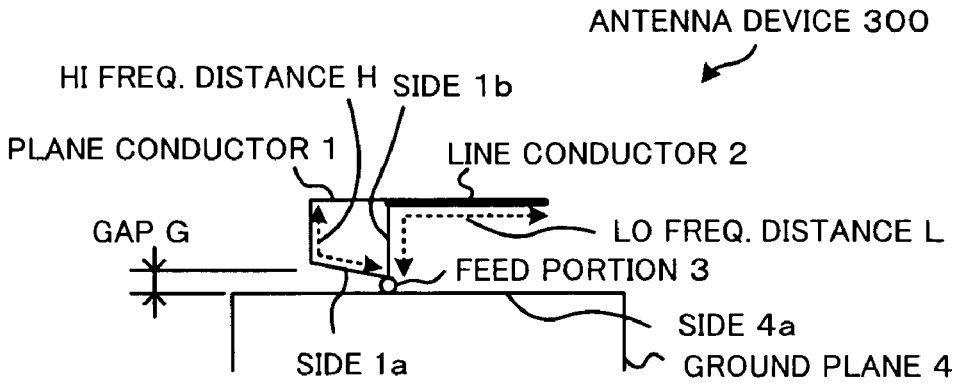
FIG. 7A is an explanatory diagram showing a configuration of an antenna device of a third embodiment of the present invention.

A third embodiment of the present invention will be described with reference to FIGS. 7A-7C. FIG. 7A is an explanatory diagram showing a configuration of an antenna device 300 of the third embodiment.

As the configuration of the antenna device 300 is similar to the configuration of the antenna device 100 of the first embodiment except for a few differences, main portions of the antenna device 300 are given same reference numerals as the main portions of the antenna device 100 for convenience of explanation.

The antenna device 300 has a plane conductor which is a modification of the plane conductor 1 of the first embodiment and is given the same reference numeral. As shown in FIG. 7A, the plane conductor 1 of the antenna device 300 has a side 1*a* facing not parallel to but more or less sloping against a side 4*a* of the ground plane 4. If the gap G between the side 1*a* and the side 4*a* is no greater than 0.3 times as long as the high frequency distance H on average, the antenna device 300 may be multiple resonant of a good performance.

Figure 7B:
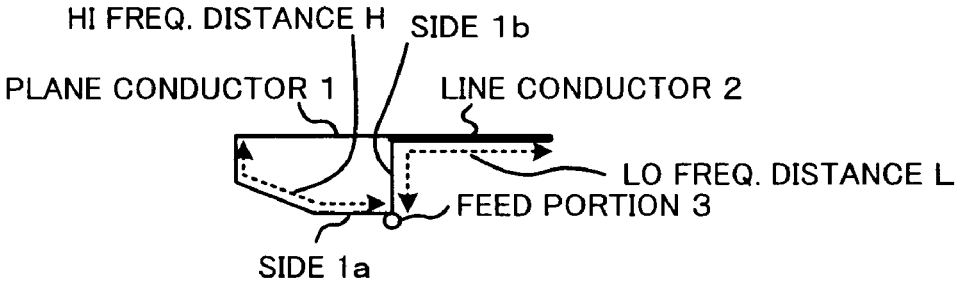
FIG. 7B is an explanatory diagram showing a configuration of a modified main portion of the antenna device of the third embodiment.

FIG. 7B is an explanatory diagram showing a configuration of a modification of the main portion of the antenna device 300 shown in FIG. 7A omitting the ground plane 4. The plane conductor 1 shown in FIG. 7B is a pentagon. As shown in FIG. 7B, a high frequency distance H is defined as indicated by a dotted line with arrows from the feed portion 3, by way of the side 1*a* of the plane conductor 1, and along sides reaching an opposite angle of the feed portion 3. The high frequency distance H relates to a relatively high one of multiple resonant frequencies of the antenna device 300.

Figure 7C:
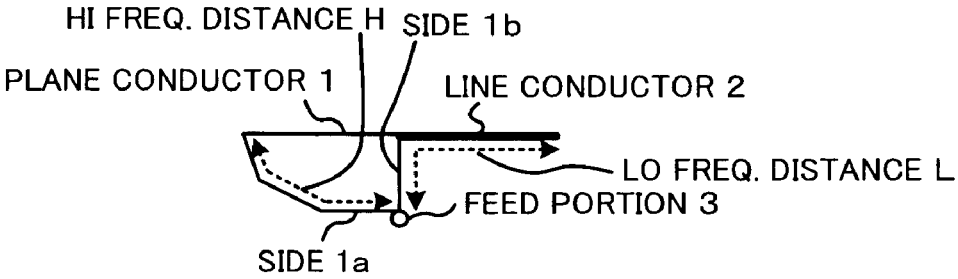
FIG. 7C is an explanatory diagram showing a configuration of another modified main portion of the antenna device of the third embodiment.

FIG. 7C is an explanatory diagram showing a configuration of a modification of the main portion of the antenna device 300 shown in FIG. 7B omitting the ground plane 4. The plane conductor 1 shown in FIG. 7C is a pentagon. As shown in FIG. 7C, a high frequency distance H is defined as indicated by a dotted line with arrows from the feed portion 3, by way of the side 1*a* of the plane conductor 1, and along sides reaching an opposite angle of the feed portion 3. The high frequency distance H relates to a relatively high one of multiple resonant frequencies of the antenna device 300.

An angle of the plane conductor 1 may be made round, although not so shown in FIGS. 7A-7C. The sides related to the high frequency distance H are not limited to a straight line but may be an arc. Similarly, the side 1*b* related to the low frequency distance L are not limited to a straight line but may be an arc. In such cases, the high frequency distance H or the low frequency distance L is a distance along the arc.

The line conductor 2 is arranged not limited to parallel or perpendicular to the side 4*a* of the ground plane 4 but may be sloping against the side 4*a*.

According to the third embodiment of the present invention described above, the antenna device 300 may be configured to have multiple resonant frequencies and broadband characteristics as the antennas of the first and second embodiments, where each of the resonant frequencies is clearly associated with a dimension of each portion of the antenna.

A fourth embodiment of the present invention will be described with reference to FIG. 8, an explanatory diagram showing a configuration of an antenna device 400 of the fourth embodiment.

As the configuration of the antenna device 400 is similar to the configuration of the antenna device 100 of the first embodiment except for a few differences, main portions of the antenna device 400 are given same reference numerals as the main portions of the antenna device 100 for convenience of explanation.

The antenna device 400 has a line conductor 2 that is shaped differently from the line conductor 2 of each of the previous embodiments. The line conductor 2 is folded back without being open-ended and is grounded by being connected to the side 4*a* of the ground plane 4 around the feed portion 3.

It is generally true that if an antenna element formed by a line conductor is arranged close to a ground plane, the antenna may suffer from a decrease of input impedance, a difficulty in impedance matching and degraded characteristics.

Figure 8:
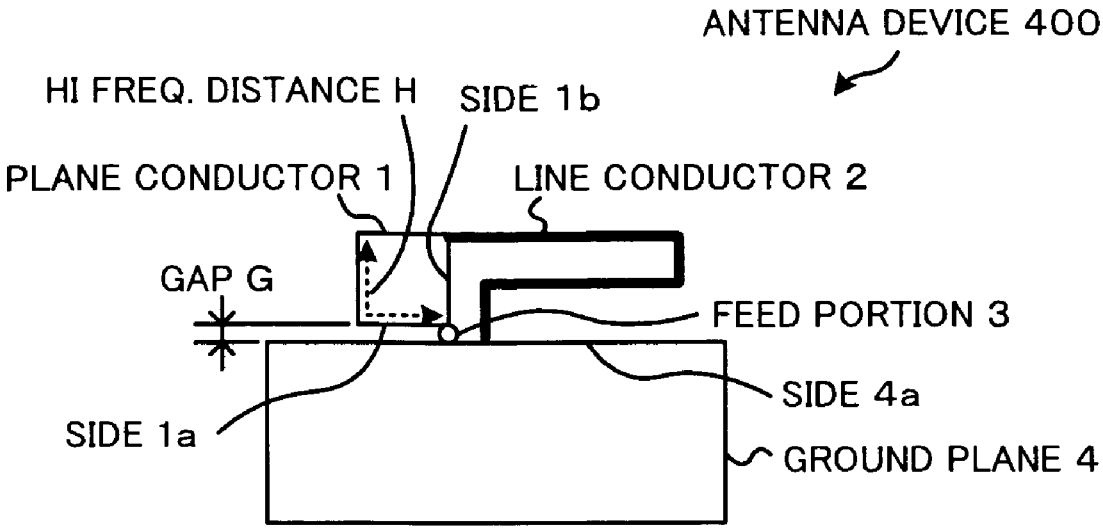
FIG. 8 is an explanatory diagram showing a configuration of an antenna device of a fourth embodiment of the present invention.

According to the fourth embodiment of the present invention described above, the antenna device 400 may prevent the input impedance from decreasing and may improve the characteristics by having the line conductor 2 folded back as shown in FIG. 8.

In the descriptions of the above embodiments, each of the shapes, configurations and locations of the plane, line and ground plane conductors, or each of the values provided as the conditions of the simulations, has been given as an example and may be variously modified within a scope of the present invention, such as including a meander-shaped line conductor, adding a lumped constant element or a parasitic element, etc.

The particular hardware or software implementation of the pre-sent invention may be varied while still remaining within the scope of the present invention. It is therefore to be understood that within the scope of the appended claims and their equivalents, the invention may be practiced otherwise than as specifically described herein.

What is claimed is:

1. An antenna device comprising:

a ground plane having a first side;

a plane conductor shaped like a polygon having a second side and a third side crossing each other, the plane conductor being arranged almost on a same plane as the ground conductor, the plane conductor being provided with a feed portion around the crossing between the second side and the third side, the plane conductor being arranged such that the second side faces the first side and the third side is almost perpendicular to the first side, and the plane conductor being configured to have a first resonant frequency determined by a first distance between the feed portion and an angle of the plane conductor diagonally opposite the feed portion, the first distance including a length of the second side; and a line conductor arranged almost on the same plane as the ground conductor, the line conductor being connected to the plane conductor around an end of the third side being opposite the feed portion, and the line conductor being configured to have a second resonant frequency which is lower than the first resonant frequency determined by a second distance between the feed portion and an end of the line conductor including lengths of the third side and the line conductor.

2. The antenna device of claim 1, wherein the first side and the second side are parallel to each other.

3. The antenna device of claim 1, wherein an average of a gap between the first side and the second side is smaller than nearly 0.3 times as long as the first distance.

4. The antenna device of claim 1, wherein the end of the line conductor is open.

5. The antenna device of claim 1, wherein the end of the line conductor is grounded.

6. An antenna device configured to have a first resonant frequency and a second resonant frequency, comprising:

a ground plane having a first side;

a plane conductor shaped like a polygon having a second side and a third side crossing each other, the plane conductor having a first angle between the second side and the third side, the plane conductor having a second angle diagonally opposite the first angle, the plane conductor being arranged almost on a same plane as the ground plane, the plane conductor having a feed portion around the first angle, the second side facing the first side, the third side being almost perpendicular to the first side, and a distance between the feed portion and the second angle including a length of the second side being nearly 0.3 times as long as a wavelength of the first resonant frequency; and a line conductor arranged almost on the same plane as the ground plane, the line conductor being connected to the plane conductor around an end of the third side being opposite the feed portion, the line conductor having an open end, and a distance between the feed portion and the open end of the line conductor including lengths of the line conductor and the third side being nearly a quarter times as long as a wavelength of the second resonant frequency.

7. The antenna device of claim 6, wherein an average of a gap between the first side and the second side is smaller than nearly 0.3 times as long as the distance between the feed portion and the second angle of the plane conductor.

8. The antenna device of claim 6, wherein the plane conductor further comprises a fourth side that is opposite and longer than the second side.

9. A radio apparatus comprising:

a printed board including a ground plane having a first side;

a first antenna element formed by a plane conductor shaped like a polygon having a second side and a third side crossing each other, the plane conductor being arranged almost on a same plane as the ground conductor, the plane conductor being provided with a feed portion around the crossing between the second side and the third side, the plane conductor being arranged such that the second side faces the first side and the third side is almost perpendicular to the first side, and the plane conductor being configured to have a first resonant frequency determined by a first distance between the feed portion and an angle of the plane conductor diagonally opposite the feed portion, the first distance including a length of the second side; and a second antenna element formed by a line conductor arranged almost on the same plane as the ground conductor, the line conductor being connected to the plane conductor around an end of the third side opposite the feed portion, and the line conductor being configured to have a second resonant frequency which is lower than the first resonant frequency determined by a second distance between the feed portion and the open end including lengths of the third side and the line conductor.

10. The radio apparatus of claim 9, wherein the first side and the second side are parallel to each other.

11. The radio apparatus of claim 9, wherein an average of a gap between the first side and the second side is smaller than nearly 0.3 times as long as the first distance.

12. The radio apparatus of claim 9, wherein the end of the line conductor is open.

13. The radio apparatus of claim 9, wherein the end of the line conductor is grounded.

* * * * *